US005363023A

United States Patent [19]

Choho

[11] Patent Number: 5,363,023

[45] Date of Patent: Nov. 8, 1994

[54] PAPER SHEET TRANSFER DEVICE

[75] Inventor: Satoshi Choho, Kawasaki, Japan

[73] Assignee: Canon Kabushiki Kaisha, Tokyo, Japan

[21] Appl. No.: 942,214

[22] Filed: Sep. 9, 1992

[30] Foreign Application Priority Data

Sep. 10, 1991 [JP] Japan ..... 3-230297

[51] Int. Cl.[5] ..... G03G 15/14

[52] U.S. Cl. ..... 318/70; 318/91; 355/317; 355/326 R

[58] Field of Search ..... 355/203, 204, 317, 208, 355/308, 309, 133, 326; 271/8.1; 219/216; 318/66, 68, 69, 77, 80, 70, 91, 561, 34; 364/426.01, 807; 432/60; 346/153.1

[56] References Cited

U.S. PATENT DOCUMENTS

| | | | |
|---|---|---|---|
| 4,001,838 | 1/1977 | Maddox | 346/153.1 |
| 4,506,321 | 3/1985 | Comstock et al. | 318/561 |
| 4,788,572 | 11/1988 | Slayton et al. | 355/317 |
| 4,806,097 | 2/1989 | Palm et al. | 219/216 |
| 5,148,089 | 9/1992 | Adachi et al. | 318/70 |

*Primary Examiner*—William M. Shoop, Jr.
*Assistant Examiner*—John W. Cabeca
*Attorney, Agent, or Firm*—Fitzpatrick, Cella, Harper & Scinto

[57] ABSTRACT

In the present invention, a plurality of states of a transfer motor and those of a feed motor in a paper sheet transferring device located in a copying machine or the like are detected, and a plurality of sets are generated on the basis of the states according to fuzzy membership functions and fuzzy rules to determine the speed of the feed motor. A position of a center of gravity of a single area obtained by ORing the plurality of generated sets is determined as a control variable of the feed motor.

12 Claims, 14 Drawing Sheets

FUZZY RULE

| ANTECEDENT PART OF THE RULE | CONSEQUENT PART OF THE RULE |
|---|---|
| DISTANCE DEVIATION = DL AND SPEED DEVIATION = VL AND ACCELERATION DEVIATION = AL | CONTROL VARIABLE = OA |
| DISTANCE DEVIATION = DL AND SPEED DEVIATION = VL AND ACCELERATION DEVIATION = AE | CONTROL VARIABLE = OA |
| DISTANCE DEVIATION = DL AND SPEED DEVIATION = VL AND ACCELERATION DEVIATION = AG | CONTROL VARIABLE = OA |
| DISTANCE DEVIATION = DL AND SPEED DEVIATION = VE AND ACCELERATION DEVIATION = AL | CONTROL VARIABLE = OA |
| DISTANCE DEVIATION = DL AND SPEED DEVIATION = VE AND ACCELERATION DEVIATION = AE | CONTROL VARIABLE = OA |
| DISTANCE DEVIATION = DL AND SPEED DEVIATION = VE AND ACCELERATION DEVIATION = AG | CONTROL VARIABLE = OX |
| DISTANCE DEVIATION = DL AND SPEED DEVIATION = VG AND ACCELERATION DEVIATION = AL | CONTROL VARIABLE = OA |
| DISTANCE DEVIATION = DL AND SPEED DEVIATION = VG AND ACCELERATION DEVIATION = AE | CONTROL VARIABLE = OX |
| DISTANCE DEVIATION = DL AND SPEED DEVIATION = VG AND ACCELERATION DEVIATION = AG | CONTROL VARIABLE = OX |
| DISTANCE DEVIATION = DE AND SPEED DEVIATION = VL AND ACCELERATION DEVIATION = AL | CONTROL VARIABLE = OA |
| DISTANCE DEVIATION = DE AND SPEED DEVIATION = VL AND ACCELERATION DEVIATION = AE | CONTROL VARIABLE = OA |
| DISTANCE DEVIATION = DE AND SPEED DEVIATION = VL AND ACCELERATION DEVIATION = AG | CONTROL VARIABLE = OX |
| DISTANCE DEVIATION = DE AND SPEED DEVIATION = VE AND ACCELERATION DEVIATION = AL | CONTROL VARIABLE = OA |
| DISTANCE DEVIATION = DE AND SPEED DEVIATION = VE AND ACCELERATION DEVIATION = AE | CONTROL VARIABLE = OX |
| DISTANCE DEVIATION = DE AND SPEED DEVIATION = VE AND ACCELERATION DEVIATION = AG | CONTROL VARIABLE = OS |
| DISTANCE DEVIATION = DE AND SPEED DEVIATION = VG AND ACCELERATION DEVIATION = AL | CONTROL VARIABLE = OX |
| DISTANCE DEVIATION = DE AND SPEED DEVIATION = VG AND ACCELERATION DEVIATION = AE | CONTROL VARIABLE = OS |
| DISTANCE DEVIATION = DE AND SPEED DEVIATION = VG AND ACCELERATION DEVIATION = AG | CONTROL VARIABLE = OS |
| DISTANCE DEVIATION = DG AND SPEED DEVIATION = VL AND ACCELERATION DEVIATION = AL | CONTROL VARIABLE = OX |
| DISTANCE DEVIATION = DG AND SPEED DEVIATION = VL AND ACCELERATION DEVIATION = AE | CONTROL VARIABLE = OX |
| DISTANCE DEVIATION = DG AND SPEED DEVIATION = VL AND ACCELERATION DEVIATION = AG | CONTROL VARIABLE = OS |
| DISTANCE DEVIATION = DG AND SPEED DEVIATION = VE AND ACCELERATION DEVIATION = AL | CONTROL VARIABLE = OX |
| DISTANCE DEVIATION = DG AND SPEED DEVIATION = VE AND ACCELERATION DEVIATION = AE | CONTROL VARIABLE = OS |
| DISTANCE DEVIATION = DG AND SPEED DEVIATION = VE AND ACCELERATION DEVIATION = AG | CONTROL VARIABLE = OS |
| DISTANCE DEVIATION = DG AND SPEED DEVIATION = VG AND ACCELERATION DEVIATION = AL | CONTROL VARIABLE = OS |
| DISTANCE DEVIATION = DG AND SPEED DEVIATION = VG AND ACCELERATION DEVIATION = AE | CONTROL VARIABLE = OS |
| DISTANCE DEVIATION = DG AND SPEED DEVIATION = VG AND ACCELERATION DEVIATION = AG | CONTROL VARIABLE = OS |

FIG. 4

PAPER SHEET TRANSFER DEVICE

BACKGROUND OF THE INVENTION

The present invention relates to a paper sheet transferring device which includes a transfer motor for transferring a paper sheet from a cassette on which the sheets of paper are placed, and a paper feed motor for feeding the paper sheet to an objective position.

The aforementioned paper sheet transfer device is extensively used in copying machines or the like. That is, the paper sheet transfer device is used as an automatic transfer device for automatically transferring originals (paper sheets) to be copied to a reading position.

In order to copy a plurality of originals on one recording sheet, e.g., two A4 sized originals on one A3 sized recording sheet, a technique to transfer the originals to the reading position and perform the copying process an once has been proposed. In this technique, it is important to transfer the originals at the shortest intervals for a high-speed copying process.

Hence, in the aforementioned type of transferring device, a motor for taking in and transferring an original placed on the cassette and a motor for feeding the original transferred by the transfer motor to the reading position are controlled at the same speed by the well known phase locked loop (PLL) method.

However, even when the drive of the two different motors is started at the same time, if transfer, feed or stoppage of the original are performed in sequence before the motors are rotated at the same speed, the distance between the forward end of the subsequent original and the rear end of the preceding original varies, causing the subsequent original to be laid on top of the preceding original or causing the subsequent original to be separated from the preceding original excessively. In some cases, the subsequent paper sheet may push the preceding original and be damaged.

SUMMARY OF THE INVENTION

In view of the aforementioned drawbacks of the conventional paper sheet transfer device, an object of the present invention is to provide a paper sheet transfer device for sequentially transferring and feeding paper sheets which enables the distance between the continuously fed paper sheets to be maintained constant, and which has a simple structure.

To achieve the aforementioned object, the present invention provides a paper sheet transfer device having a transfer motor for transferring sheets of paper, and a feeding motor for feeding the paper sheets to an objective position, which comprises a detection means for detecting a difference in a relative state value between the transfer motor and the feed motor, a control means for controlling a rotational speed of at least either of the transfer motor or the feed motor, a storage means for storing a plurality of relation data between the difference in the relative state value and a control variable to be controlled by the control means, a first calculation means for calculating a plurality of control variable areas corresponding to the relations stored in the storage means from the difference in the relative state value which is detected by the detection means, and a second calculation means for calculating a predetermined state position in a synthetic area expressed by the control variable areas calculated by the calculation means. The quantity representing the predetermined state position calculated by the second calculation means is used as the control variable by the control means.

Alternately, the present invention provides a paper sheet transferring device having a transfer motor for transferring sheets of paper and a feed motor for feeding the paper sheets to an objective position, which comprises a control means for controlling the speed of either the transfer motor or the feed motor, a first pulse signal generation means for generating a pulse signal having a period corresponding to the rotational speed of the transfer motor, a second pulse signal generation means for generating a pulse signal having a period corresponding to rotational speed of the feed motor, a state value detection means for detecting the speed of the transfer motor and a paper sheet transferring distance by the transfer motor on the basis of the pulse signal generated from said first pulse signal generation means, as well as the speed of the feed motor and a paper sheet feeding distance by the feed motor on the basis of the pulse signal generated by the second pulse signal generation means, a distance deviation detection means for detecting a deviation between the transferring distance and the feeding distance detected by the state value detection means, a speed deviation detection means for detecting a deviation between the transferring speed of the transfer motor and the feeding speed of the feed motor, an acceleration deviation detection means for detecting a deviation between an transferring acceleration corresponding to a change in the transferring speed of the transfer motor and a feeding acceleration corresponding to a change in the feeding speed of the feed motor, a storage means for storing a fuzzy membership function for the distance deviation, a fuzzy membership function for the speed deviation, a fuzzy membership function for the acceleration function, serving as an antecedent of fuzzy control, a fuzzy membership function for the motor which is a control object of the control means, serving as a consequent of fuzzy control, as well as a plurality of fuzzy rules between the antecedent and the consequent, and a detection means for detecting a control variable of the motor which is the control object on the basis of a position of a center of gravity of an area obtained by ORing a plurality of control variable areas for the motor which is the control object obtained by the fuzzy rules stored in the storage means. The control means controls the speed of the motor which is the control object on the basis of the control variable obtained by the detection means.

Another object of the present invention is to provide a paper sheet transfer device located on a copying machine for automatically transferring originals to a reading position in sequence which enables the distance between the continuous paper sheets to be maintained constant, and which has a simple structure.

To achieve the above object, the present invention provides a paper sheet transferring device loaded in a copying machine for sequentially transferring a plurality of originals to a predetermined reading position, which comprises a transfer motor for transferring the originals set on an original placing portion, a feed motor for feeding the original transferred by a drive of the transfer motor to the original reading position, a control means for controlling a speed of either the transfer motor or the feed motor, a first pulse signal generation means for generating a pulse signal having a period corresponding to the rotational speed of the transfer motor, a second pulse signal generation means for generating a pulse signal having a period corresponding to the rotational speed of the feed motor, a state value detection means for detecting the speed of the transfer motor and a paper sheet transferring distance by the transfer motor on the basis of the pulse signal generated from said first pulse signal generation means, as well as the speed of the feed motor and a paper sheet feeding distance by the feed motor on the basis of the pulse signal generated by the second pulse signal generation means, a distance deviation detection means for detecting a deviation between the transferring distance and the feeding distance which are detected by the state value detection means, a speed deviation detection means for detecting a deviation between the transferring speed of the transfer motor and the feeding speed of the feed motor, an acceleration deviation detection means for detecting a deviation between an transferring acceleration corresponding to a change in the transferring speed of the transfer motor and a feeding acceleration corresponding to a change in the feeding speed of the feed motor, a storage means for storing a fuzzy membership function for the distance deviation, a fuzzy membership function for the speed deviation, a fuzzy membership function for the acceleration function, serving as an antecedent of fuzzy control, a fuzzy membership function for the motor which is a control object of the control means, serving as a consequent of fuzzy control, as well as a plurality of fuzzy rules between the antecedent and the consequent, and a detection means for detecting a control variable of the motor which is the control object on the basis of a position of a center of gravity of an area obtained by ORing a plurality of control variable areas for the motor which is the control object obtained by the fuzzy rules stored in the storage mean. The control means controls the speed of the motor which is the control object on the basis of the control variable obtained by the detection means.

Other features of the invention will be apparent from the following description taken in conjunction with the accompanying drawings, in which like reference characters designate the same or similar parts throughout the figures thereof.

BRIEF DESCRIPTION OF THE DRAWINGS

FIG. 4 shows the entire fuzzy rules employed in the embodiment of FIG. 1;

DESCRIPTION OF THE PREFERRED EMBODIMENTS

An embodiment of the present invention will be described in detail with reference to the accompanying drawings. In this embodiment, a copying machine provided with an automatic paper sheet transfer device will be described.

Description of Structure

Figure 13:
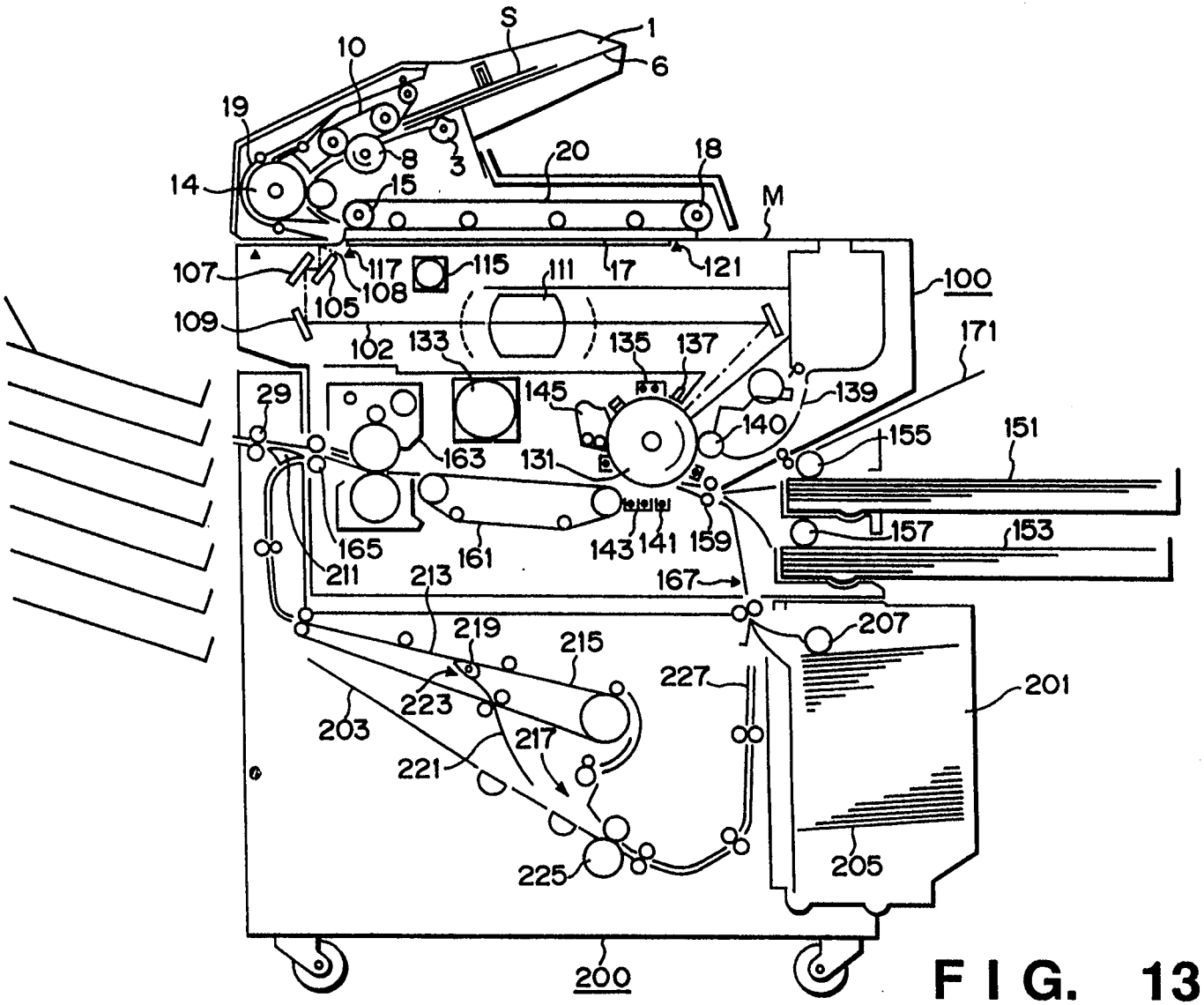
FIG. 13 is a cross-sectional view of a copying machine of the embodiment of FIG. 1.

FIG. 13 illustrates the structure of the copying machine of this embodiment.

Figure 1:
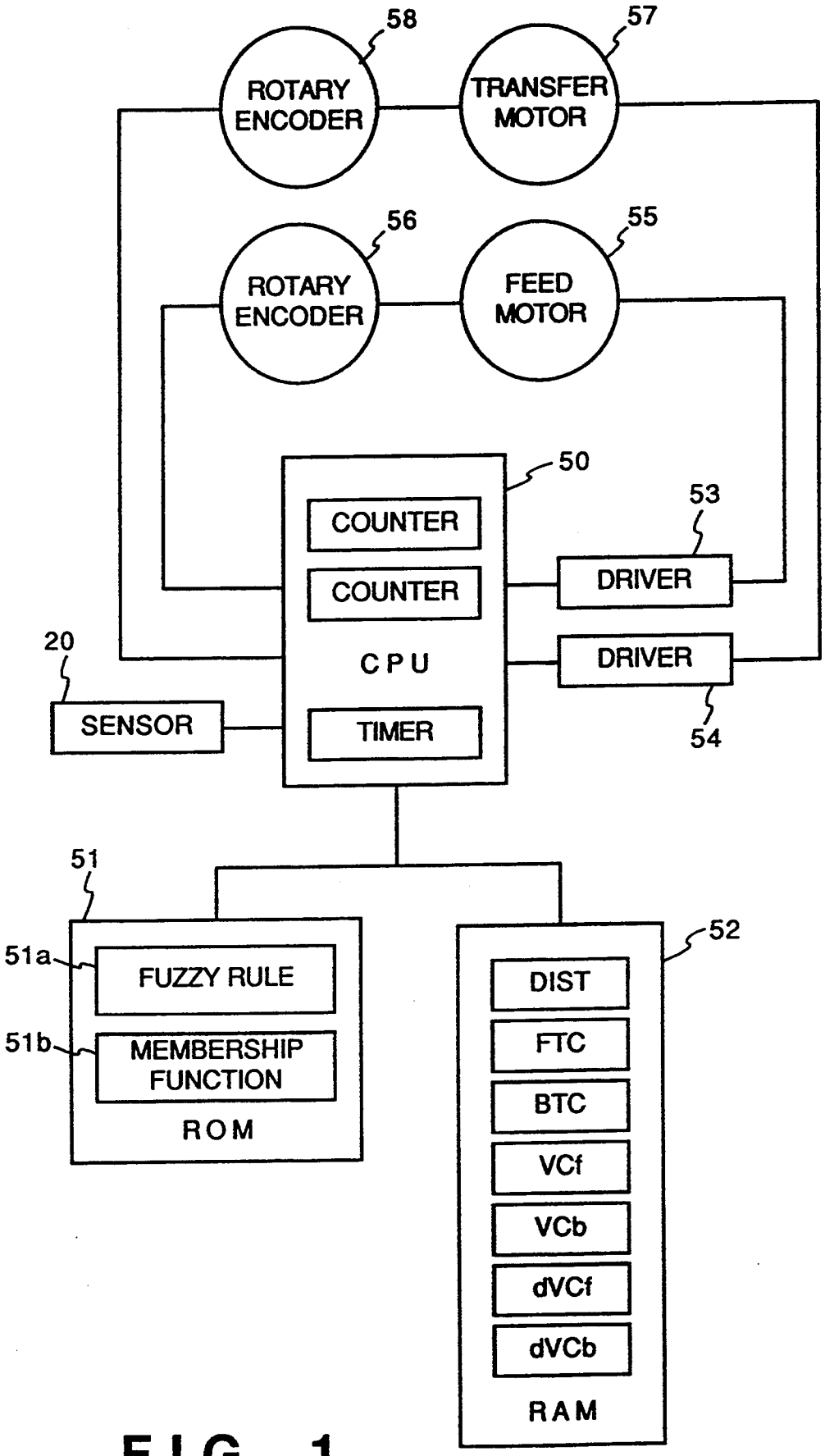
FIG. 1 is a block diagram of a paper sheet transferring device showing an embodiment of the present invention.

In FIG. 13, reference numeral 100 denotes a copying machine body; 17, a platen glass on which originals to be copied are placed; 103, a lamp (exposure lamp) for illuminating the surface of the original placed on the platen glass 17; 105, 107 and 109, scanning mirrors for changing the optical path of the original; 111, a lens for condensing the light reflected by the scanning mirror 109; 113, a fourth scanning mirror for deflecting the optical path; 115, a motor for moving an optical unit (including the exposure lamp 103 and the scanning mirrors 103, 107 and 109) to the right and left, as viewed in FIG. 1; and 117 and 121, sensors for detecting that the optical unit has come to their positions.

Reference numeral 131 denotes a photosensitive drum; 133, a main motor for rotating the photosensitive drum 131; a high-voltage unit for charging the photosensitive drum 131; 137, a blank exposure unit; 139, a developer; 140, a developing roller; 141, a transfer charger; 143, a separation charger; and 145, a cleaning device.

The recording papers are fed from a manual paper feeding port 171 one by one or from an upper cassette 151 or a lower cassette 153 where a plurality of sheets of recording paper are set. Reference numerals 155 and 157 denote paper feed rollers; 159, register rollers; 161, a transfer belt for transferring the recording paper on which recording has been conducted toward a fixing device; 163, a fixing device for fixing the transferred recording paper utilizing heat and pressure; 165, rollers for sending out the fixed sheet to a transfer path, which will be described later, or to a sorter 300; and 167, a sensor for detecting a sheet on which two-sided recording is to be conducted.

The surface of the photosensitive drum 131 is a seamless photosensitive member composed of a photoconductive member and a conductive member. The drum 131 is rotatably supported. The drum 131 starts rotating in a direction indicated by an arrow when the main motor 133 is activated in response to the depression of a copy starting key, which will be described later. After the predetermined rotation control and potential control process (pretreatment) of the drum 131 has been completed, the original placed on the platen glass 101 is illuminated by the illumination lamp 103 provided integrally with the first scanning mirror 105. The light reflected by the original passes through tile first scanning mirror 105, the second scanning mirror 107, the third scanning mirror 109, the lens 111 and then the fourth scanning mirror 113 and then reaches the drum 131.

After corona charged by the high-voltage unit 135, the drum 131 is slit exposed to the image (an original image) illuminated by the illumination lamp 103 to form an electrostatic latent image on the drum 131 by the known Carlson process.

Next, the electrostatic latent image on the photosensitive drum 131 is developed by the developing roller 140 of the developer 139 to form a visible toner image which is to be transferred onto a transfer sheet by the transfer charger 141.

A transfer sheet placed in the upper cassette 151 or the lower cassette 153 or set at the manual paper feeding port 171 is fed into the interior of the copying machine body by the paper feed roller 155 or 157 or a manual paper feed roller. The register rollers 159 synchronize the feeding of the transfer sheet with the rotation of the photosensitive drum 131 so that the distal end of the transfer sheet can be brought into coincidence with the distal end of the latent image. The toner image on the drum 131 is transferred onto the transfer sheet by the passage of the transfer sheet between the transfer charger 341 and the drum 131. The separation charger 143 separates the transfer sheet on which transfer has been conducted from the drum 131. The separated transfer sheet is fed to the fixing device 163 by the transfer belt 161. The sheet on which fixing has been conducted utilizing pressure and heat is discharged to the outside of the copying machine body 100 by the discharge rollers 165.

The drum 131 from which the toner image has been transferred 131 continues rotating, during which time the surface thereof is cleaned by the cleaning device 145 consisting of a cleaning roller and an elastic blade.

A pedestal 200 temporarily accepts and retains the sheet which has been sent out from the copying machine body 100 for the post treatment. The pedestal 200 can be separated from the body 100. The pedestal 200 has a deck 201 which can accommodate 2,000 sheets of transfer paper, and an intermediate tray 203 for two-sided copying. A lifter 205 of the deck 201 can lift the stack of transfer sheets set in the deck 201 so that the transfer sheet located on the top of the stack is always in contact with the paper feed roller 207 at a predetermined force. That is, the lifter of the deck 201 gradually rises as the number of transfer sheets which have been used increases.

Reference numeral 211 denotes a flapper which switches over the two-sided or multiple recording passage and the discharge passage; 213, 215, transfer passages of the transfer belts; 217, an intermediate tray weight for pressing the transfer sheets, the transfer sheet which has passed through the discharge flapper 211 and the transfer passages 213 and 215 being turned over and accommodated in the intermediate tray 203 for the two-sided copying; 219, a flapper for selecting the two-sided recording passage or the multiple recording passage, the flapper being disposed between the transfer passages 213 and 215, the transfer sheet being led to a transfer passage 221 for multiple recording when the flapper is pivoted upward; 223, a multiple paper discharge sensor for detecting the rear end of the transfer sheet when the multiple flapper 219 is driven; 225, paper feed rollers for feeding the transfer sheet toward the drum 131 via a passage 227; and 229, discharge rollers for discharging the transfer sheet to the outside.

For the two-sided recording (two-sided copying) or multiple recording (multiple copying), first, the transfer sheet on which transfer has been conducted is accommodated in the intermediate tray 203 via the passages 213 and 215 by pivoting the paper discharge flapper 211 of the body 100 upward. For two-sided recording, the multiple flapper 219 is lowered. For multiple recording, the multiple flapper 219 is raised. The intermediate tray 203 can accommodate, for example, 99 sheets of transfer paper. The transfer sheets placed in the intermediate tray 203 are pressed by the intermediate tray weight 217. For the two-sided or multiple recording, the transfer sheets accommodated in the intermediate tray 203 are led one by one starting with the lowermost one to the register rollers 159 of the body 100 via the passage 227 by the action of the combination of the paper feed rollers 225 and the weight 217.

An automatic original transfer device 1 of this embodiment will be described below.

When a copying starting key (not shown) is depressed in a state wherein originals S to be copied are placed on an original tray 6, the original located at the bottom of the stack is sent toward a separation belt 10 by an insertion roller 5. At that time, the separation belt 10 and the separation rollers 8 reliably separate the single original. The separated original is sent out toward a paper feed roller 15 by a transfer roller 14. A belt 20 extends between the paper feed roller 15 and a roller 18. The belt 30 is in contact with the platen glass 17 at a predetermined force. The friction between the surface of the belt 30 and the original is greater than that between the original and the platen glass 17 so as to allow the rotation of the paper feed roller 15 to position the original sent by the transfer roller 14 on the upper surface of the platen glass 17. After copying has been completed, the paper feed roller 15 is reversely driven to send the original toward the transfer roller 14. The original passes through a transfer passage 19 and is then discharged onto the original tray 6.

In the case where a plurality of originals are copied on one recording sheet, it takes time to start to transfer a subsequent original onto the platen glass 17 after a previous original on which copying to be conducted has been set on the platen glass 17, resulting in a decrease in the copying speed. It is therefore desirable to start to transfer the subsequent original while the previous original is being transferred with no space between the previous and subsequent originals.

Such a desirable process is conventionally conducted to eliminate the time loss. However, conventionally, the transfer roller 14 and the feed roller 15 are driven at the same speed only by the PLL control to reduce the distance between the subsequent and preceding originals. In that case, it is difficult to maintain that distance constant in an actual operation, as mentioned above.

Hence, in this embodiment, the state of the transfer roller 14 and that of the feed roller 15 are detected, and fuzzy control is conducted on the detected states. The fuzzy control will be described below in detail. In this embodiment, only the process of transferring the original set on the original tray 6 onto the platen glass 17 will be described to simplify the description.

Figure 2:
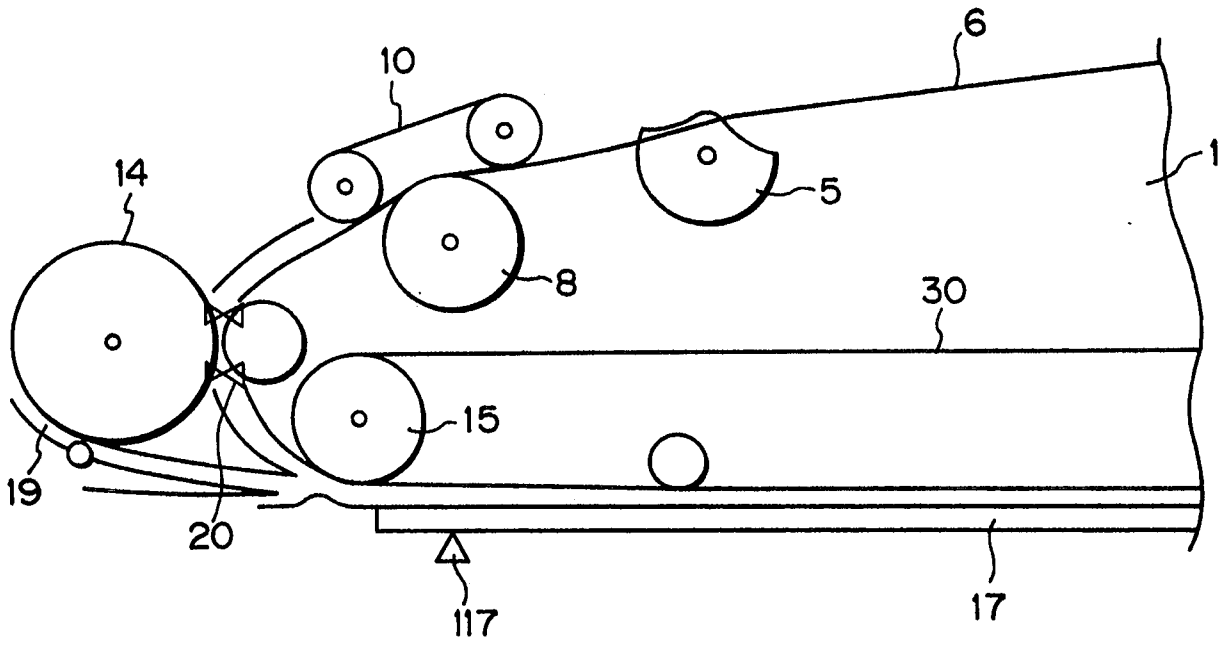
FIG. 2 is a schematic cross-sectional view of a mechanism of the embodiment of FIG. 1.

FIG. 2 is an enlarged view of the essential parts of the automatic original transfer device 1. In FIG. 2, reference numeral 20 denotes a transfer end detecting sensor for detecting that the transfer roller 14 has completed transfer of the original.

FIG. 1 is a block diagram of the major components of the automatic original transfer device 1. In FIG. 1, reference numeral 57 denotes a transfer motor for driving the transfer roller 14; 54, a driver for the transfer motor 57; 58, a rotary encoder coupled to the drive shaft of the transfer motor 57 to produce a signal having a period corresponding to the rotary speed of the transfer motor 57, the rotary speed of the transfer roller 14, i.e., the transfer speed, being determined by detecting the number of signals detected in a unit time; 55, a feed motor for driving the feed roller 15; 53, a driver for the feed motor 55; and 56, a rotary encoder coupled to the drive shaft of the paper feed motor 55 to detect the rotary speed (paper feed speed).

Reference numeral 50 denotes a central processing unit for controlling the whole automatic original transfer device 1 by conducting speed control by the known PLL control or by the fuzzy inference, which will be described later, or by controlling switching over between the two speed control modes. A ROM 51 stores the programs for controlling the CPU 100 (corresponding to the flowcharts of FIGS. 6 through 12, which will be described later) and a fuzzy rule 51*a* and a membership function 51*b*. A RAM 52 is used as the working area for the various controls and fuzzy inference. The results of the detection of the aforementioned transfer end detecting sensor, i.e., signals (high/low), are supplied to the CPU 50.

The RAM 52 has various buffers, as shown in FIG. 1.

Buffer DIST stores the data representing the distance between the adjacent sheets. Buffers FTC and BTC are used to detect the state values of the transfer motors 57 and 55. The stored values are counted up by the timer interrupt. Buffer VCf stores the data representing the previous transfer speed of the transfer motor 57, and buffer VCb stores the data representing the newest transfer speed of the transfer motor 57. Similarly, buffer dVCf stores the data corresponding to the previous feeding speed of the feeding motor 55, and buffer dVCb stores the newest feeding speed of the feeding motor 55. The detail of each of the buffers will be described later in detail.

Outline of Operation

In this embodiment, the speed of the feeding motor is controlled by the fuzzy inference of the transfer motor 57 and feeding motor 55. How such a control is conducted will be described below.

The CPU 50 counts the number of pulses output from the encoder 58 of the transfer motor 57, and measures the time required for a fixed number of pulses to be output. The obtained time is stored in the RAM together with the previously counted time. The CPU 50 similarly counts the number of pulses output from the encoder 56 of the feeding motor 55, and measures the time required for a fixed number of pulses to be output. The obtained time is stored in the RAM together with the previously obtained time. The CPU 50 also calculates the distance between the rear end of the preceding original and the forward end of the subsequent original.

To perform fuzzy inference, the present embodiment uses the following three state values:

1. Deviation between the present transfer distance of the original by the transfer motor 57 and the feeding speed of the feeding motor 55.
2. Deviation between the present transfer speed of the transfer motor 57 and the feeding speed of the feeding motor 55.
3. Deviation between the present acceleration of the transfer motor 57 and the acceleration of the feeding motor 55.

To perform the speed control of the feeding motor 55, the present embodiment uses the following control variable:

4. Speed control variable of the feeding motor 55.

FIGS. 3A through 3D show fuzzy sets called the membership functions of the state values 1 through 3 and control variable 4.

Figure 3A:
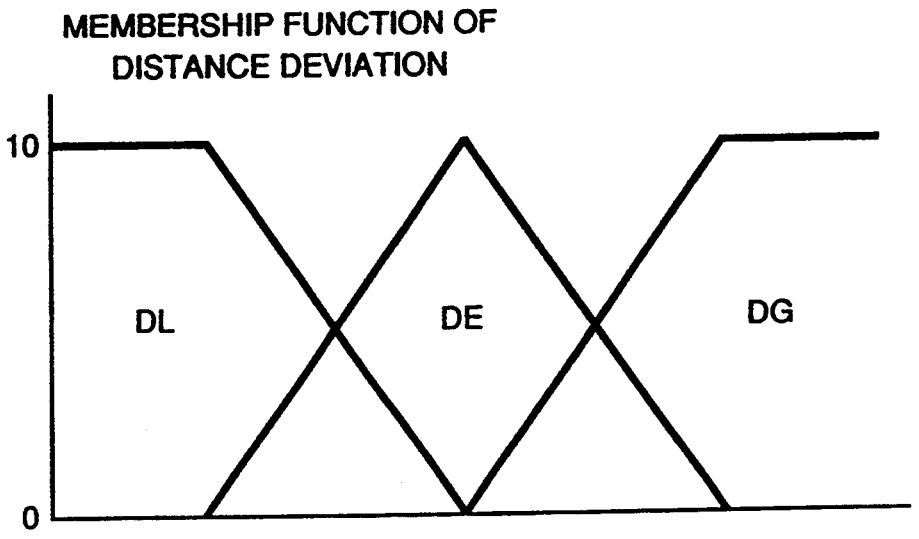
FIGS. 3A through 3D illustrate the concepts of each fuzzy rules employed in the embodiment of FIG. 1.
Figure 3B:
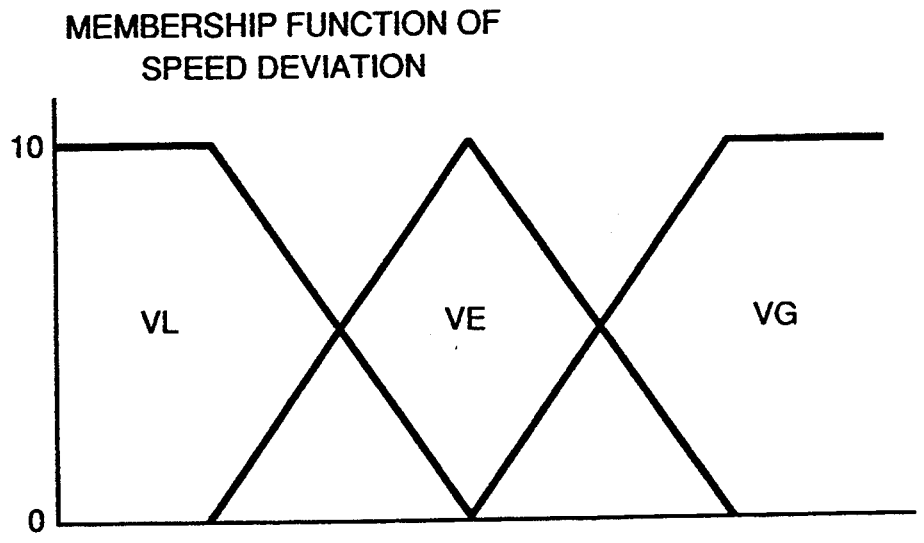
Figure 3C:
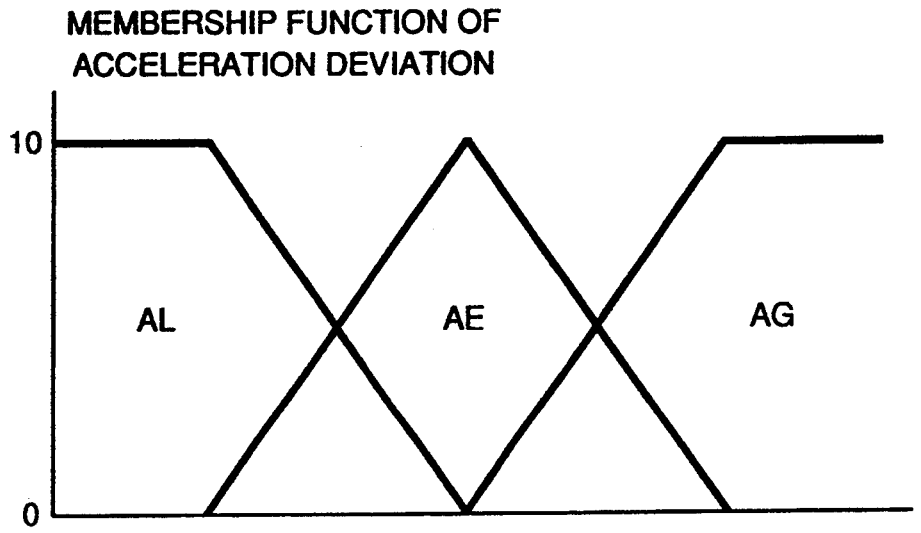
Figure 3D:
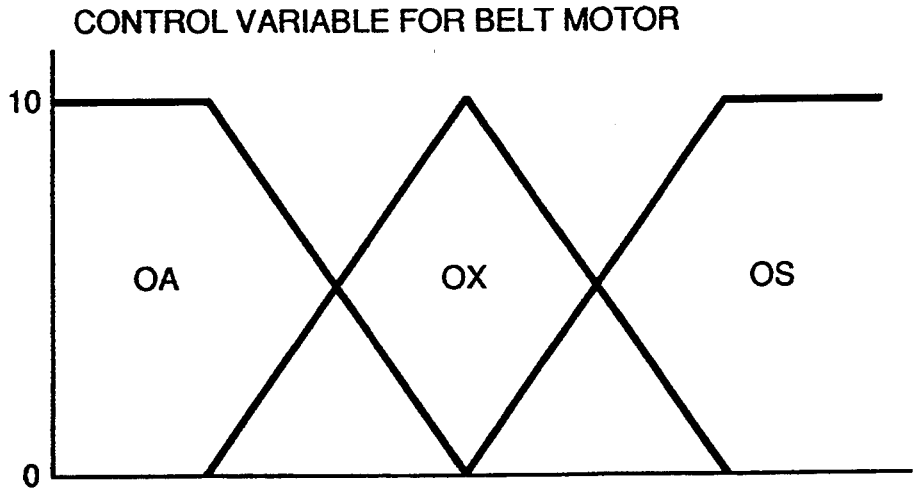

FIG. 3A shows the membership functions of the distance deviation. FIG. 3B shows the membership functions of the speed deviation. FIG. 3C shows the membership functions of the acceleration deviation. FIG. 3D shows the membership functions of the feeding motor control variable.

Each of the distance deviation, speed deviation, acceleration deviation and feeding motor control variable is divided into several sets. Each of the sets has the following signification.

Distance Deviation

1) DL: the transfer distance by the transfer motor 57 is less than the feeding distance of the feeding motor 55.
2) DE: the transfer distance by the transfer motor 57 is equal to the feeding distance of the feeding motor 55.
3) DG: the transfer distance by the transfer motor 57 is greater than the feeding distance of the feeding motor 55.

Speed Deviation

1) VL: the transfer speed by the transfer motor 57 is less than the feeding speed of the feeding motor 55.
2) VE: the transfer speed by the transfer motor 57 is equal to the feeding speed of the feeding motor 55.
3) VG: the transfer speed by the transfer motor 57 is greater than the feeding speed of the feeding motor 55.

Acceleration Deviation

1) AL: the acceleration of the transfer motor 57 is less than the acceleration of the feeding motor 55.
2) AE: the acceleration of the transfer motor 57 is equal to the acceleration of the feeding motor 55.
3) AG: the acceleration of the transfer motor 57 is greater than the acceleration of the feeding motor 55.

The output based on the results of the inference, i.e., the control variable of the speed of the feeding motor 55

1) OS: the amount of current supplied to the feeding motor 55 is decreased.
2) OX: the amount of current supplied to the feeding motor 55 remains the same.
3) OA: the amount of current supplied to the feeding motor 55 is increased.

In this embodiment, the degree with which the value belongs to the set is expressed by a value ranging from 0 to 10. As mentioned above, the relations between the individual fuzzy sets are stored in the ROM 101 as the fuzzy rule 101*a*.

Next, the method of calculating the control variable of the feeding motor 55 from the state values of the distance deviation, speed deviation and acceleration deviation will be described below. To determine the control variable of the feeding motor, the following fuzzy rules may be used.

Rule 1:

If the distance deviation=DL, the speed deviation=VL and the acceleration deviation=AL, the control variable of the feeding motor=OA.

Rule 2:

If the distance deviation=DE, the speed deviation=VE, and the acceleration deviation=AE, the control variable of the feeding motor=OX.

Such fuzzy rules are set when necessary.

FIG. 4 shows the entire fuzzy rules used in this embodiment.

Figure 5:
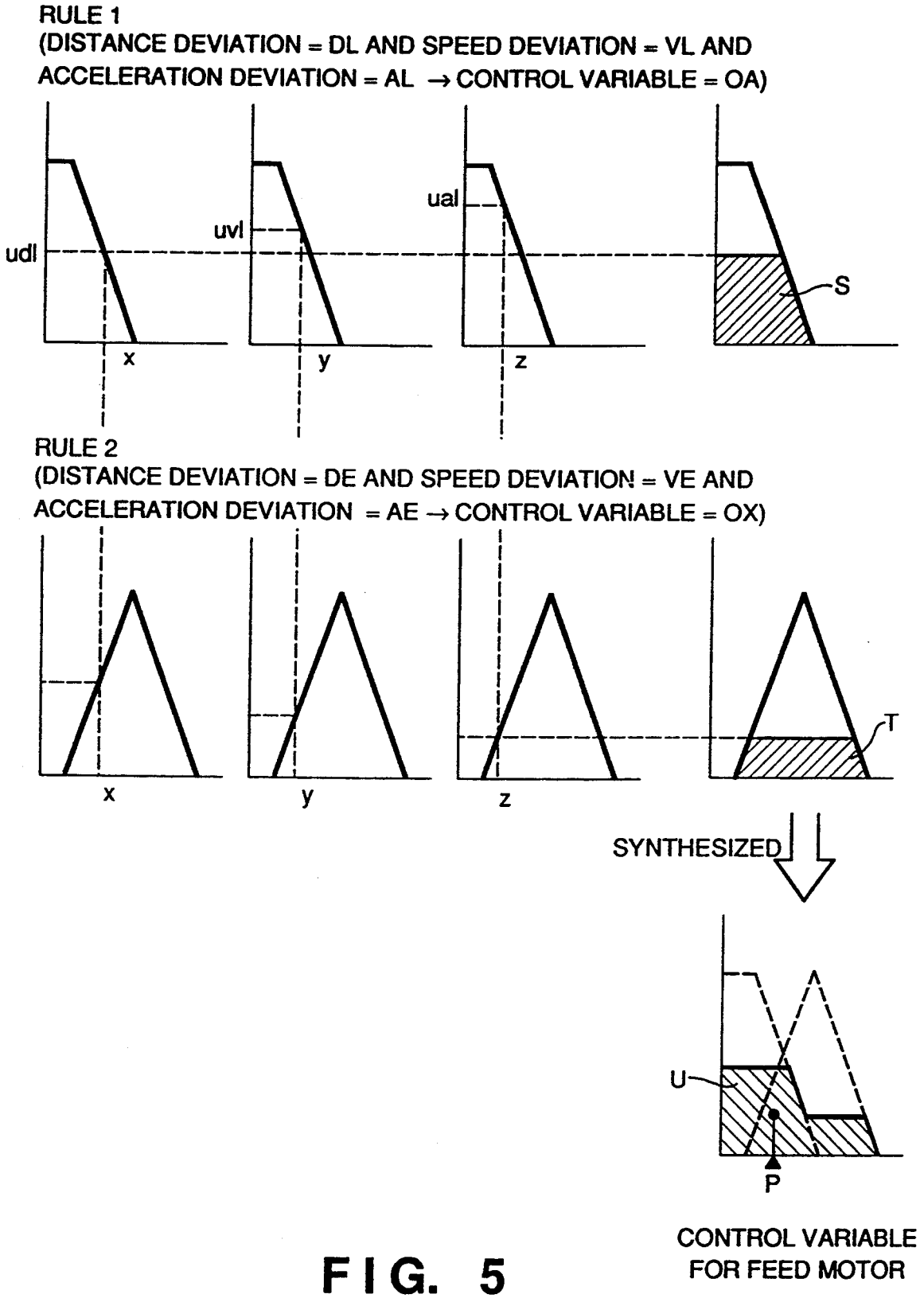
FIG. 5 illustrates a method of obtaining a control variable according to the fuzzy rules in the embodiment of FIG. 1.

FIG. 5 shows an example of a method of calculating the control variable of the feeding motor by performing the fuzzy inference using rule 1 and rule 2. In this example, the distance deviation=x, the speed deviation=y, and the acceleration deviation=z.

According to rule 1, first, it is indicated on the basis of the membership function of the distance deviation that input x belongs to set DL by degree of ud1. It is also indicated on the basis of the membership function of the speed deviation that input y belongs to set VL by degree of uv1. Also, it is indicated on the basis of the membership function of the acceleration deviation that input z belongs to set AL by degree of ua1.

Thereafter, the minimum value is selected from among ud1, uv1 and ua1 as the degree with which that value satisfies the consequent portion of rule 1. The membership function OA of the control variable of the feeding motor, corresponding to the obtained minimum value in ud1, uv1 and ua1, is obtained as a hatched trapezoidal indicated by S in FIG. 5.

Calculations on rule 2 on the basis of the input state values x, y and z are conducted similarly to obtain a hatched portion T.

Subsequently, set S and set T are ORed to create set U. The center of gravity P of set U is set as the control variable of the feeding motor 55 obtained by fuzzy inference.

In the aforementioned example, two rules are used. However, in an actual operation, the fuzzy set of the control variable is calculated from the degree with which the state value belongs to the fuzzy set using all the fuzzy rules shown in FIG. 4. The center of gravity of the area obtained by ORing the obtained control variable sets is recognized as the control variable of the highest potential (the highest reliability). The feeding motor 55 is controlled on the basis of the obtained control variable. The actual control of the feeding motor 55 is conducted by outputting a PWM signal having a duty ratio corresponding to the obtained control variable.

Description of Processing Procedures

Figure 6:
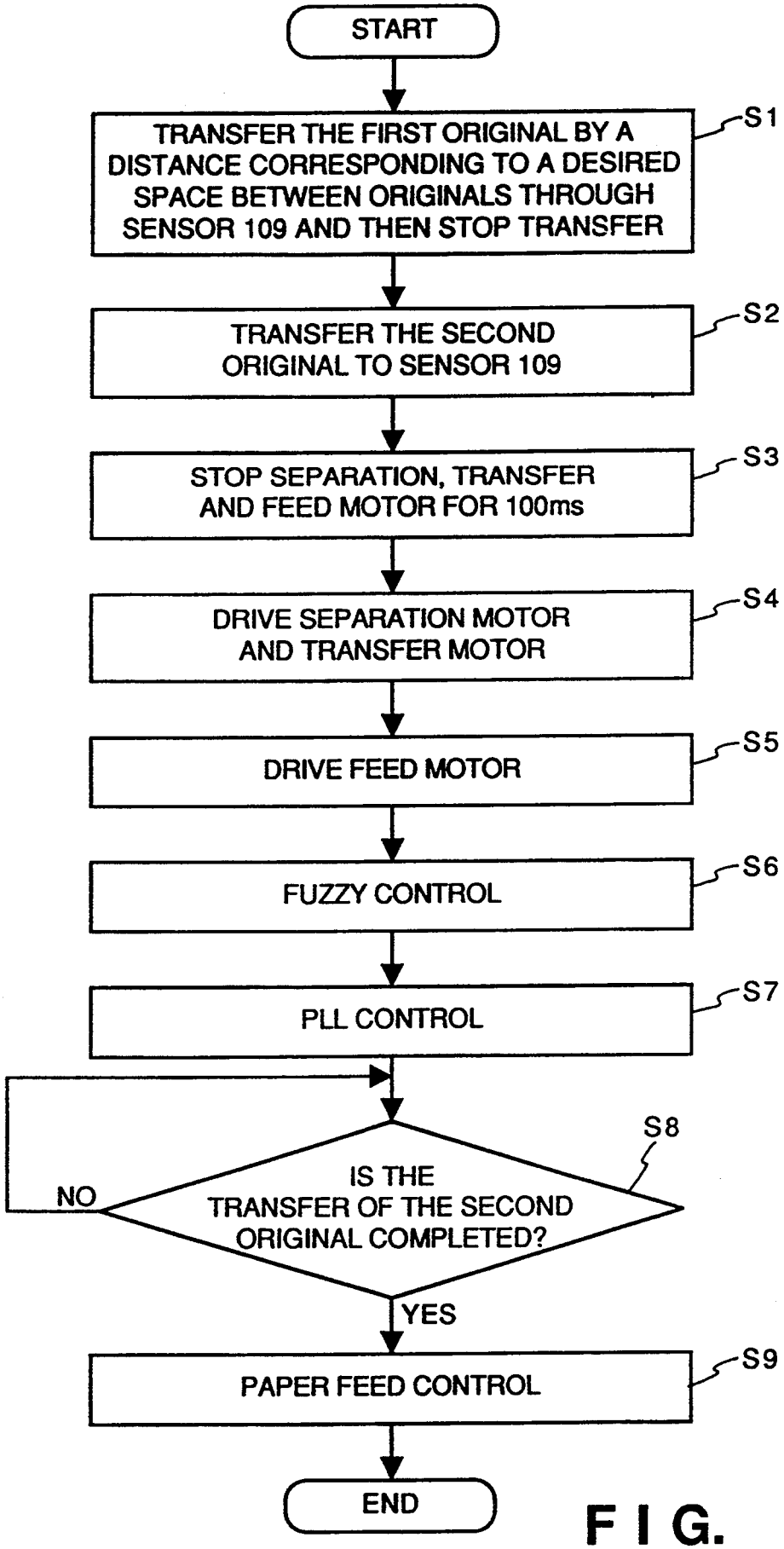
FIG. 6 is a flowchart showing the entire control operation executed in the embodiment of FIG. 1.

The operation of the automatic original transfer device 1 will be described below with reference to the flowchart of FIG. 6.

First, in step S1, the single original located at the bottom of the original stack placed on the original tray shown in FIG. 2 is transferred and fed by a predetermined distance through the sensor 20 and is then stopped. In step S2, the original (the second lowest one) located at the bottom of the original stack is transferred to a position where it faces the sensor 20 and is then stopped. In step S3, the motors (the ransfer and feeding motors, and a separation motor (not shown)) are stopped for 100 ms. In step S4, the separation motor and the transfer motor 57 are driven. In step S5, the feeding motor 55 is driven. In step S6, the aforementioned fuzzy control operation is executed. Thereafter, fuzzy control is switched to PLL control of step S7. After the second original has passed through the sensor 20, PPL control is switched to paper feeding control of step S9 to feed the both originals onto the platen glass 17 in a state wherein there is no space between the first and second originals, thereby completing the feeding process.

Fuzzy control is performed using the timer interrupt, the transfer motor clock interrupt and the feeding motor clock interrupt. However, the process by the timer interrupt is performed at a period sufficiently shorter than that with which the transfer motor interrupt or the feeding motor interrupt are conducted.

Figure 7:
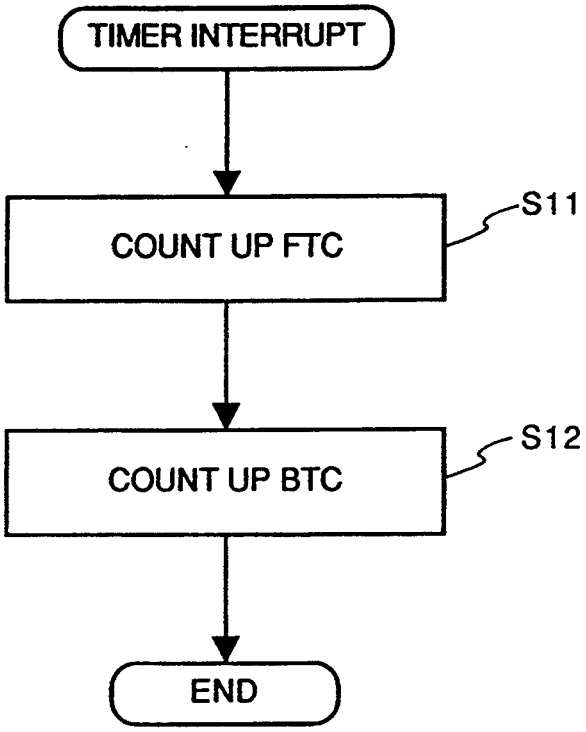
FIG. 7 is a flowchart showing a timer interrupt process of the embodiment of FIG. 1.

As shown in FIG. 7, each time the timer interrupt occurs, the value stored in the buffer FTC allocated in the RAM for the transfer motor and the value stored in the buffer BTC allocated in the RAM for the feeding motor are counted up (steps S11 and 12).

Figure 8:
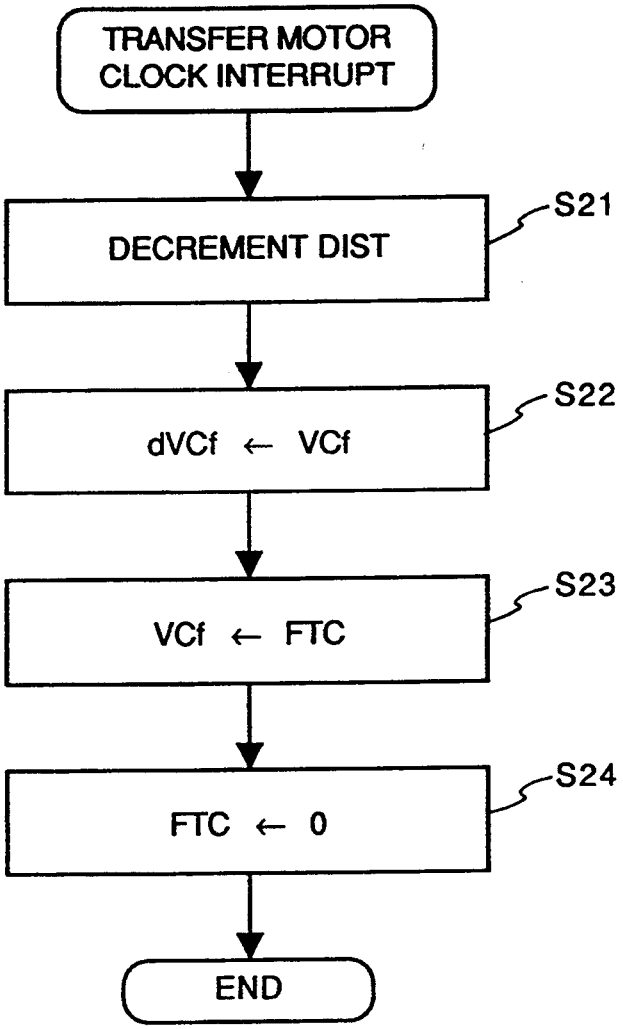
FIG. 8 is a flowchart showing a transfer motor clock interrupt process of the embodiment of FIG. 1.
Figure 9:
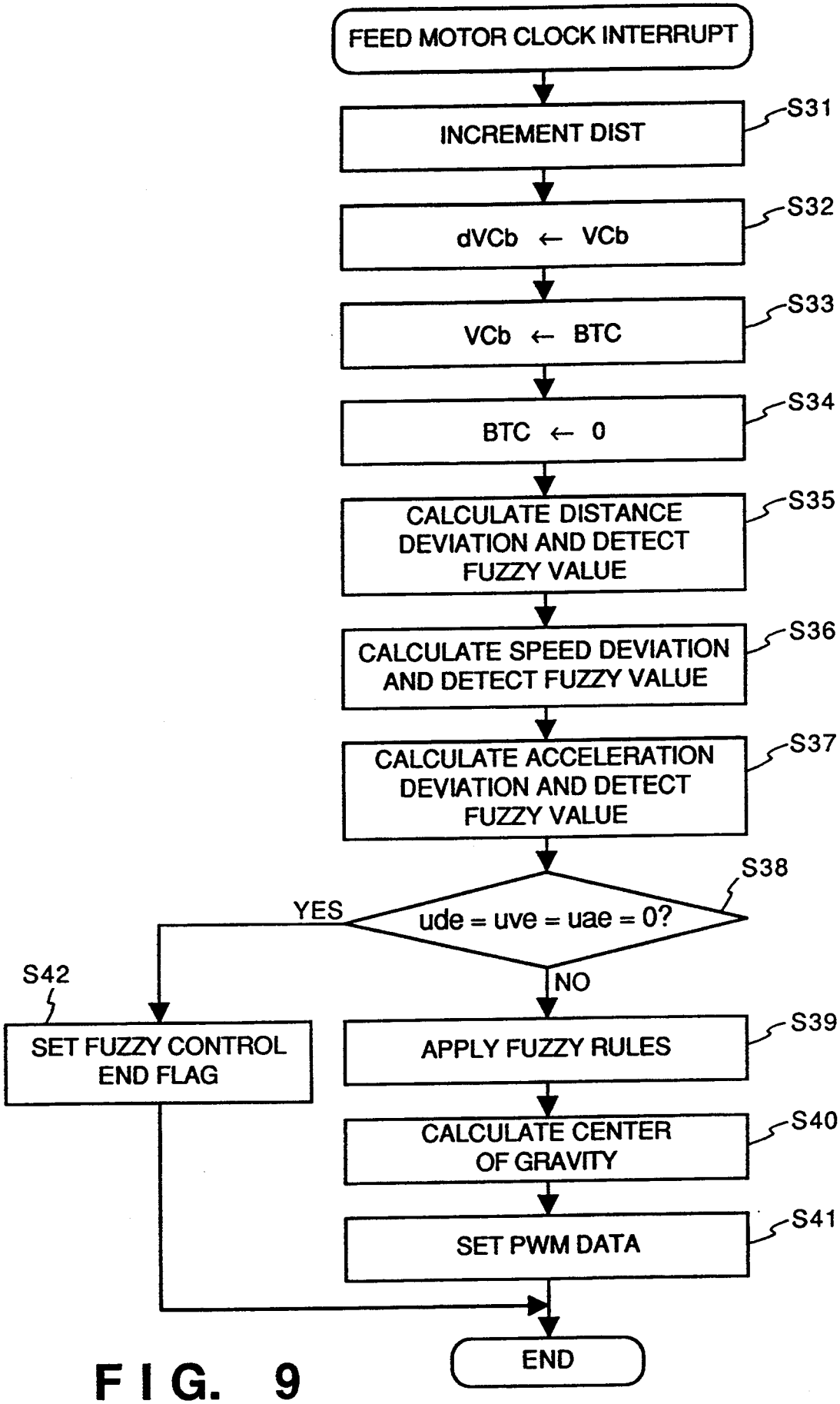
FIG. 9 is a flowchart showing a feed motor clock interrupt process of the embodiment of FIG. 1.

Next, the transfer motor clock interrupt process will be described below with reference to the flowchart of FIG. 8. This process is activated when the encoder 58 for the transfer motor 57 has output a predetermined number of pulse signals.

First, in step S21, the value stored in the buffer DIST allocated in the RAM for the distance deviation is counted down (which means that the distance has decreased). Next, in step S22, the contents of the buffer VCf secured in the RAM for calculating the speed deviation are stored in the buffer dVCf allocated for calculating the acceleration deviation (the data representing the previously detected speed of the transfer motor is saved). Next, in step S23, the contents of FTC are stored in the buffer VCf (updated by the newest data). In step S24, FTC is cleared.

The feeding motor clock interrupt process will be described below. This process is activated when the encoder 56 for the feeding motor 55 has output a predetermined number of pulse signals.

First, in step S31, DIST is counted up (which means that the distance has increased). In step S32, the contents allocated in the RAM for the acceleration deviation are stored in the buffer dVCb (the previously detected speed of the feeding motor is saved). The contents of the buffer BTC are stored in the buffer VCb (step S33). Thereafter, BTC is cleared (step S34). In step S35, the distance deviation is calculated from the buffer DIST, and the fuzzy values ud1, ud3 and udg by the distance deviation are obtained. In step S36, the speed deviation is calculated from the buffers VCf and VCb, and the fuzzy values uv1, uve and uvg by the speed deviation are obtained. In step S37, the speed deviation is calculated from the buffers dVCF and dVCb, and the fuzzy values ua1, uae and uag by the acceleration deviation are obtained.

Next, in step S38, it is determined from the obtained fuzzy values whether or not fuzzy control is switched to PLL control. If it is determined that switching over is not yet conducted, i.e., if ude=uve=uae=0 does not hold, all the fuzzy rules are applied to the fuzzy values obtained in steps S35, S36 and S37 in step S39. If it is determined that switching over is conducted, a fuzzy control ending flag is set in step S42, thereby completing the interruption process.

In step S40, the center of gravity of the synthetic region of the areas of the membership functions of the consequent portions (see FIG. 4) obtained in step S39 is calculated to obtain the amount of change (control variable) of the duty for PWM control. In step S41, the duty for PWM control is calculated using the amount of change obtained in step S40.

Figure 10:
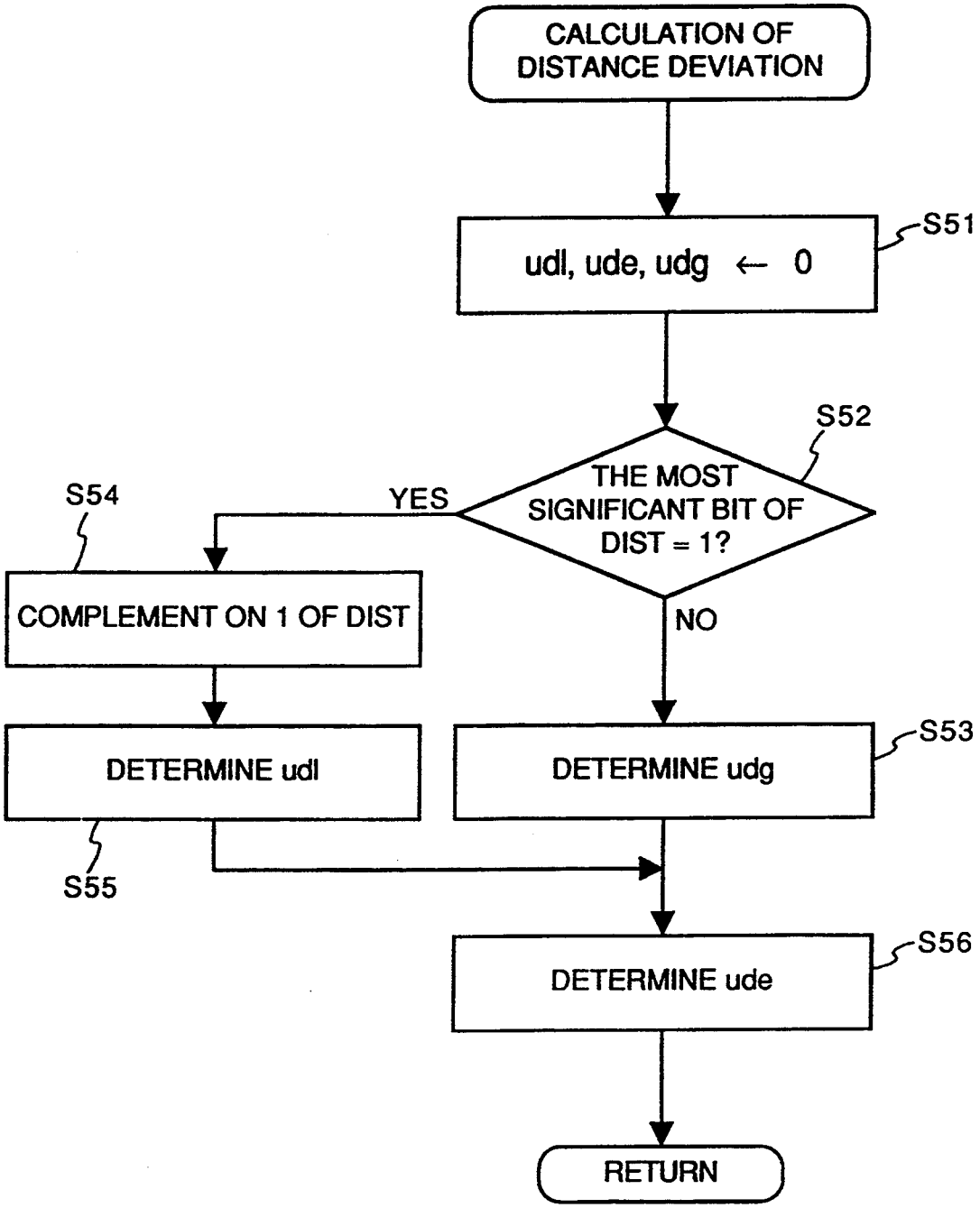
FIG. 10 is a flowchart showing a process of calculating a distance deviation in the embodiment of FIG. 1.
Figure 11:
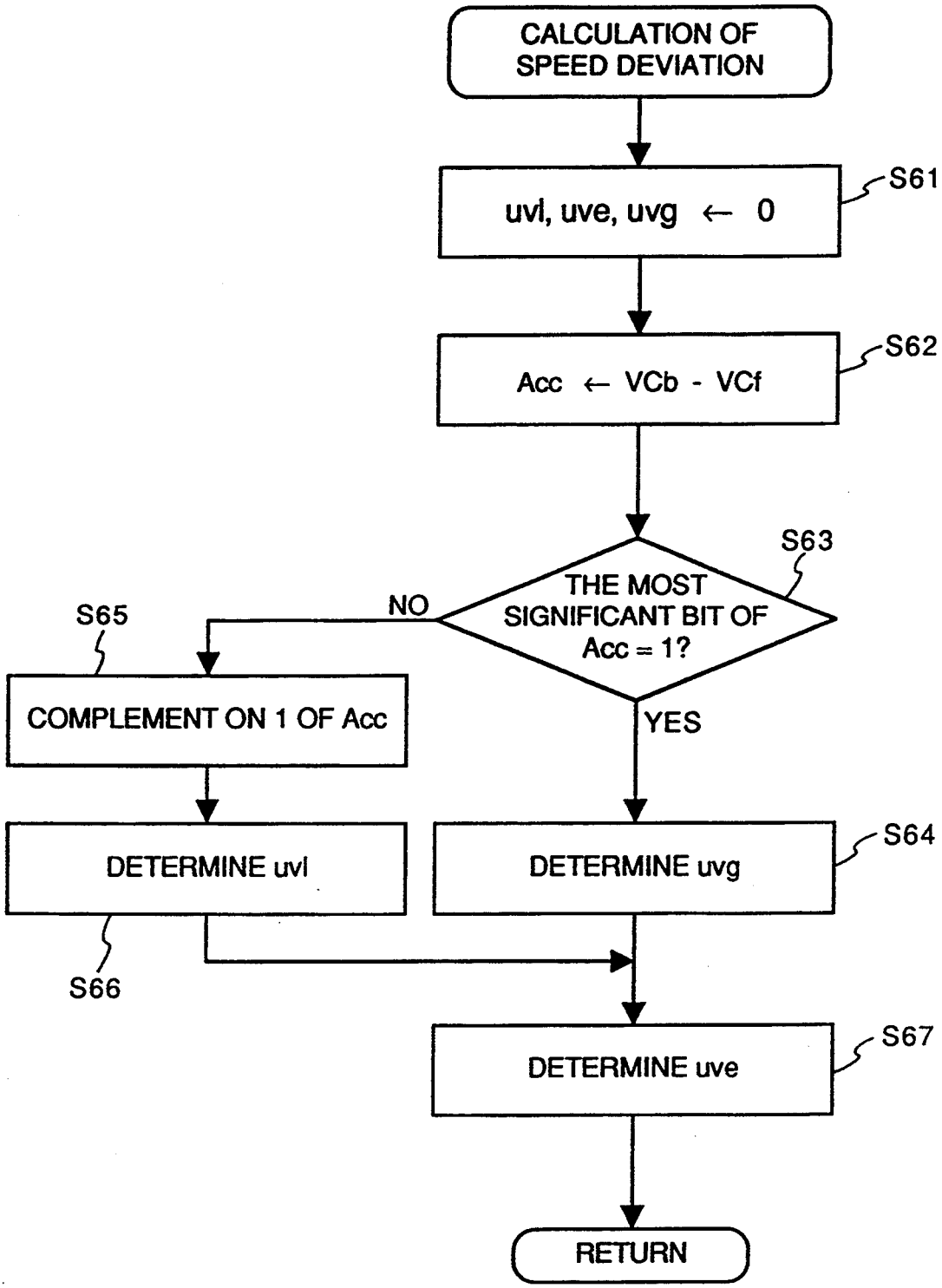
FIG. 11 is a flowchart showing a process of calculating a speed deviation in the embodiment of FIG. 1.

The method of calculating the distance deviation and of detecting the fuzzy values thereof, conducted in the aforementioned process, will be described below with reference to the flowchart of FIG. 10.

First, in step S51, ud1, ude and udg are initialized. In step S52, it is determined whether or not the most significant bit of the 8 bits in the buffer DIST is "1". The buffer DIST is an 8-bit coded data whose most significant bit (code) indicates whether the distance between the originals is great or less. If the most significant bit is not 1", that is, if the distance between the originals is great, fuzzy value udg is obtained from the membership function representing that "the transferring and feeding distance is great" in step S53, and the process goes to step S56. If the most significant bit of DIST is "1" (a negative value), the complement on "1" of buffer DIST is obtained in step S54, and then fuzzy value ud1 is obtained from the membership function representing that "the transferring and feeding distance is less" in step S55.

In step S56, fuzzy value ude is obtained from the membership function representing that "the transferring and feeding distance is equal".

The method of calculating the speed deviation and the method of detecting the fuzzy values thereof, which are similar to those described above, will be described with reference to FIG. 11.

First, in step S61, uv1, uve and uvg are initialized, and in step S62, the value in buffer VCf is deducted from the value in buffer VCb (the obtained value being assigned to an accumulator Acc) to obtain the relative difference between the paper feeding speed and the paper transferring speed. In step S63, it is determined whether or not the most significant bit of the accumulator is "0" to examine which motor is running faster, the paper feeding motor 55 or the transferring motor 57. If the most significant bit is not "0" (which means that it is "1"), fuzzy value uvg is obtained from the member ship function indicating that "the paper feeding motor is faster than the paper transferring motor" in step S64, and then the process goes to step S67. If the most significant bit is "0", fuzzy value uv1 is obtained from the membership function representing that "the paper feeding motor is slower than the paper transferring motor".

In step S67, fuzzy value uve is obtained from the membership function representing that "the speed of the feeding motor and that of the transferring motor are the same".

Figure 12:
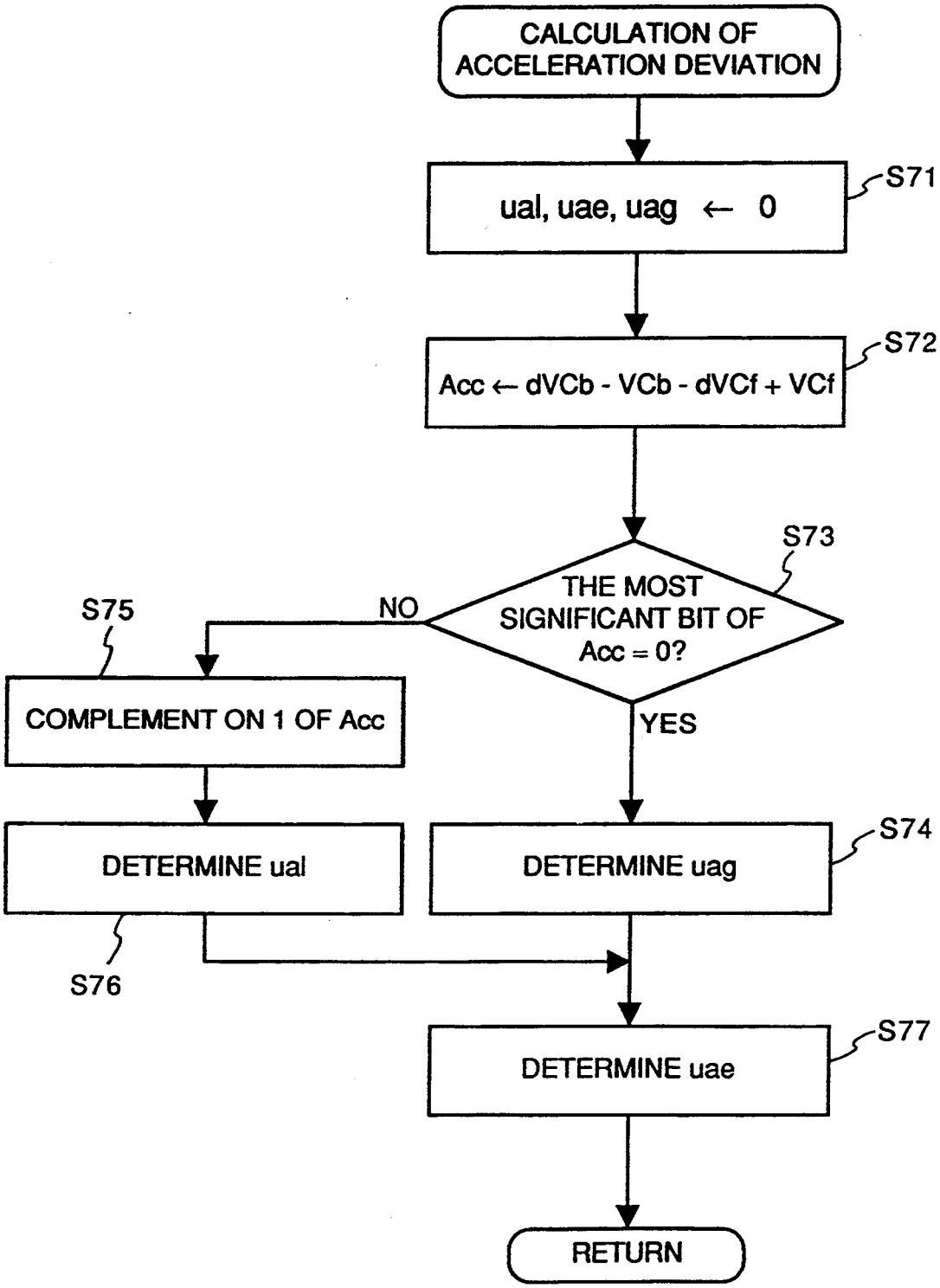
FIG. 12 is a flowchart showing a process of calculating an acceleration deviation in the embodiment of FIG. 1.

The method of calculating the acceleration deviation and of detecting the fuzzy values thereof will be described below with reference to FIG. 12.

First, ua1, uae and uag are initialized to "0" in step S71. Next, in step S72, the value in buffer VCb is deducted from the value in buffer dVCb, and the obtained value is stored in the accumulator. The value in dVCf is deduced from the value in the accumulator, and then VCf is added to the accumulator. In other words, the difference between the previous paper feeding speed and the present paper feeding speed (the acceleration of the paper feeding motor) is deducted from the difference between the previous paper transferring speed and the present paper transferring speed (the acceleration of the paper transferring motor) to obtain the difference of these two accelerations.

In step S73, it is determined whether or not the most significant bit of the accumulator is "0", i.e., it is determined whether or not the acceleration of the paper transferring motor is greater than that of the paper feeding motor. If the most significant bit is not "0" (which means that it is "1"), fuzzy value uag is obtained from the membership function representing that "the acceleration of the paper transferring motor is greater than that of the paper feeding motor" in step S74, and then the process goes to step S77. If the most significant bit of the accumulator is "0", fuzzy value ua1 is obtained from the membership function representing that "the acceleration of the paper transferring motor is less than that of the paper feeding motor" in steps S75 and S76.

In step S77, fuzzy value uae is obtained from the membership function representing that "the acceleration of the paper feeding motor and that of the paper transferring motor are the same".

The thus-obtained fuzzy values are applied to all the fuzzy rules to obtain the center of gravity of the area of the membership function representing the consequent portion and hence the amount of change of the duty for PWM control. Thus, the optimum duty can be obtained, and the paper transfer motor and the paper feed motor can thus be driven at the same speed to make the amount of paper transfer and the amount of paper feed equal to each other.

As will be understood from the foregoing description, in the present embodiment, when two originals are transferred and fed in sequence, the distance between the sequential paper sheets can be maintained constant. Thus, delay of the subsequent original, overlapping of the subsequent original on the preceding original or damage to the preceding original can be eliminated.

In the above embodiment, the copying machine has been described. However, it is our intention that the invention be not limited by any of the details of description, unless otherwise specified, but rather be applied to any device for transferring and feeding a plurality of paper sheets (sheets of recording paper).

In the embodiment, the state values of the transfer motor and those of the feeding motor are detected, and the speed of the paper feeding motor is controlled on the basis of the detected state values. However, the transfer motor may be controlled.

In the embodiment, the control for setting originals on the platen glass is described, however, the present invention is not limited upon the above control. The present invention can be applied to control for discharging the originals from the reading portion. Further, the present invention is applicable to consecutive transfer of recording sheets. It goes without saying that the present invention is applicable to a paper sheet transfer device other than a copying machine.

Although the invention has been described in preferred form with a certain degree of particularity, it is understood that the present disclosure of the preferred form has been changed in the details of construction anti the combination and arrangement of the parts may be resorted to without departing of the spirit and scope of the invention hereinafter claimed.

What is claimed is:

1. A paper sheet handling system comprising:

a transfer motor for transferring sheets of paper;

a feeding motor for feeding the paper sheets transferred by said transfer motor, to a target position;

detection means for detecting a difference in a velocity value between said transfer motor and said feeding motor; and control means for controlling a rotational speed of at least one of said transfer motor and said feeding motor by using fuzzy inferential reasoning based on the velocity difference detected by said detection means, such that an interval between two consecutively feeding paper sheets is shortened.

2. A paper sheet handling system according to claim 1, wherein said control means is activated in a transient time subsequent to when the rotational speed of said transfer motor becomes constant after the drive of said transfer motor is started and when the rotational speed of said feeding motor and the rotational speed of said transfer motor become equal to each other and hence the paper sheet transferring distance and the paper sheet feeding distance become equal to each other, PLL control being conducted after the paper sheet transferring distance and the paper sheet feeding distance become equal to each other.

3. A paper sheet handling method, in a system comprising a transfer motor for transferring sheets of paper and a feeding motor for feeding the paper sheets transferred by said transfer motor, to a target position, said method comprising steps of:

detecting a difference in acceleration value between said transfer motor and said feeding motor; and controlling a rotational speed of at least one of said transfer motor and said feeding motor by using fuzzy inferential reasoning based on the acceleration difference detected by said detection step, such that an interval between two consecutively feeding paper sheets is shortened.

4. A method according to claim 3, wherein said control step is activated in a transient time subsequent to when the rotational speed of said transfer motor becomes constant after the drive of said transfer motor is started and when the rotational speed of said feeding motor and the rotation speed of said transfer motor become equal to each other and hence the paper sheet transferring distance and the paper sheet feeding distance become equal to each other, PLL control being conducted after the paper sheet transferring distance and the paper sheet feeding distance become equal to each other.

5. A paper sheet transferring device having a transfer motor for transferring sheets of paper and a feed motor for feeding the paper sheets to a target position, said device comprising:

a control means for controlling the speed of either said transfer motor or said feed motor;

a first pulse signal generation means for generating a pulse signal having a period corresponding to the rotational speed of said transfer motor;

a second pulse signal generation means for generating a pulse signal having a period corresponding to the rotational speed of said feed motor;

a state value detection means for detecting the speed of said transfer motor and a paper sheet transferring distance by said transfer motor on the basis of the pulse signal generated from said first pulse signal generation means, as well as the speed of said feed motor and a paper sheet feeding distance by said feed motor on the basis of the pulse signal generated by said second pulse signal generation means;

a distance deviation detection means for detecting a deviation between the transferring distance and the feeding distance detected by said state value detection means;

a speed deviation detection means for detecting a deviation between the transferring speed of said transfer motor and the feeding speed of said feed motor;

an acceleration deviation detection means for detecting a deviation between an transferring acceleration corresponding to a change in the transferring speed of said transfer motor and a feeding acceleration corresponding to a change in the feeding speed of said feed motor;

a storage means for storing a fuzzy membership function for the distance deviation, a fuzzy membership function for the speed deviation, a fuzzy membership function for the acceleration function, serving as an antecedent of fuzzy control, a fuzzy membership function for the motor which is a control object of said control means, serving as a consequent of fuzzy control, as well as a plurality of fuzzy rules between the antecedent and the consequent; and a detection means for detecting a control variable of the motor which is the control object on the basis of a position of a center of gravity of an area obtained by ORing a plurality of control variable areas for the motor which is the control object obtained by the fuzzy rules stored in said storage means, wherein said control means controls the speed of the motor which is the control object on the basis of the control variable obtained by said detection means.

6. The paper sheet transferring device according to claim 5, wherein said control means is activated in a transient time subsequent to when the rotational speed of said transfer motor becomes constant after the drive of said transfer motor is started and when the rotational speed of said feed motor and the rotational speed of said transfer motor become equal to each other and hence the paper sheet transferring distance and the paper sheet feeding distance become equal to each other, PLL control being conducted after the paper sheet transferring distance and the paper sheet feeding distance become equal to each other.

7. A paper sheet transferring device loaded in a copying machine for sequentially transferring a plurality of originals to a predetermined reading position, said device comprising:

a transfer motor for transferring the originals set on an original placing portion;

a feed motor for feeding the original transferred by a drive of said transfer motor to the original reading position;

a control means for controlling a speed of either said transfer motor or said feed motor;

a first pulse signal generation means for generating a pulse signal having a period corresponding to the rotational speed of said transfer motor;

a second pulse signal generation means for generating a pulse signal having a period corresponding to the rotational speed of said feed motor;

a state value detection means for detecting the speed of said transfer motor and a paper sheet transferring distance by said transfer motor on the basis of the pulse signal generated from said first pulse signal generation means, as well as the speed of said feed motor and a paper sheet feeding distance by said feed motor on the basis of the pulse signal generated by said second pulse signal generation means;

a distance deviation detection means for detecting a deviation between the transferring distance and the feeding distance which are detected by said state value detection means;

a speed deviation detection means for detecting a deviation between the transferring speed of said transfer motor and the feeding speed of said feed motor;

an acceleration deviation detection means for detecting a deviation between an transferring acceleration corresponding to a change in the transferring speed of said transfer motor and a feeding acceleration corresponding to a change in the feeding speed of said feed motor;

a storage means for storing a fuzzy membership function for the distance deviation, a fuzzy membership function for the speed deviation, a fuzzy membership function for the acceleration function, serving as an antecedent of fuzzy control, a fuzzy membership function for the motor which is a control object of said control means, serving as a consequent of fuzzy control, as well as a plurality of fuzzy rules between the antecedent and the consequent; and a detection means for detecting a control variable of the motor which is the control object on the basis of a position of a center of gravity of an area obtained by ORing a plurality of control variable areas for the motor which is the control object obtained by the fuzzy rules stored in said storage means, wherein said control means controls the speed of the motor which is the control object on the basis of the control variable obtained by said detection means.

8. The paper sheet transferring device according to claim 7, wherein said control means is activated in a transient time subsequent to when the rotational speed of said transfer motor becomes constant after the drive of said transfer motor is started and when the rotational speed of said feed motor and the rotational speed of said transfer motor become equal to each other and hence the paper sheet transferring distance and the paper sheet feeding distance become equal to each other, PLL control being conducted after the paper sheet transferring distance and the paper sheet feeding distance become equal to each other.

9. A paper sheet handling system comprising:

a transfer motor for transferring sheets of paper;

a feeding motor for feeding the paper sheets transferred by said transfer motor, to a target position;

detection means for detecting a difference in an acceleration value between said transfer motor and said feeding motor; and control means for controlling a rotational speed of at least one of said transfer motor and said feeding motor by using fuzzy inferential reasoning based on the acceleration difference detected by said detection means, such that an interval between two consecutively feeding paper sheets is shortened.

10. A paper sheet handling system according to claim 9, wherein said control means is activated in a transient time subsequent to when the rotational speed of said transfer motor becomes constant after the drive of said transfer motor is started and when the rotational speed of said feed motor and the rotational speed of said transfer motor become equal to each other and hence the paper sheet transferring distance and the paper sheet feeding distance become equal to each other, PLL control being conducted after the paper sheet transferring distance and the paper sheet feeding distance become equal to each other.

11. A paper sheet handling method, in a system comprising a transfer motor for transferring sheets of paper and a feeding motor for feeding the paper sheets transferred by said transfer motor, to a target position, said method comprising steps of:

detecting a difference in acceleration value between said transfer motor and said feeding motor; and controlling a rotational speed of at least one of said transfer motor and said feeding motor by using fuzzy inferential reasoning based on the acceleration difference detected by said detection step, such that an interval between two consecutively feeding paper sheets is shortened.

12. A method according to claim 11, wherein said control means is activated in a transient time subsequent to when the rotational speed of said transfer motor becomes constant after the drive of said transfer motor is started and when the rotational speed of said feed motor and the rotational speed of said transfer motor become equal to each other and hence the paper sheet transferring distance the paper sheet feeding distance become equal to each other, PLL control being conducted after the paper sheet transferring distance and the paper sheet feeding distance become equal to each other.

* * * * *

UNITED STATES PATENT AND TRADEMARK OFFICE

CERTIFICATE OF CORRECTION

PATENT NO. : 5,363,023
DATED : November 8, 1994
INVENTOR(S) : SATOSHI CHOHO

It is certified that error appears in the above-indentified patent and that said Letters Patent is hereby corrected as shown below:

Column 2,
line 13, "to" should read --to the--; and
line 28, "an" should read --a--.
Column 3,
line 35, "mean." should read --means--.
Column 4,
line 33, "a high-voltage unit" should read --135, a high-voltage unit--; and
line 64, "tile" should read --the--.
Column 5,
line 22, "341" should read --141--.
Column 9,
line 59, "ransfer" should read --transfer--.
Column 14,
line 2, "an" should read --a--.
Column 15,
line 6, "an" should read --a--.
Column 16,
line 39, "feed" should read --feeding--; and
line 42, "distance" should read --distance and--.

Signed and Sealed this

Thirteenth Day of June, 1995

*Attest:*

*Attesting Officer*

BRUCE LEHMAN

*Commissioner of Patents and Trademarks*